US006785966B2

(12) United States Patent
Berns

(10) Patent No.: US 6,785,966 B2
(45) Date of Patent: Sep. 7, 2004

(54) BOX CUTTER WITH AUTORETRACTING BLADE

(75) Inventor: Harald Berns, Wuppertal (DE)

(73) Assignee: Martor KG, Solingen (DE)

( * ) Notice: Subject to any disclaimer, the term of this patent is extended or adjusted under 35 U.S.C. 154(b) by 32 days.

(21) Appl. No.: 10/374,756

(22) Filed: Feb. 26, 2003

(65) Prior Publication Data

US 2003/0159290 A1 Aug. 28, 2003

(30) Foreign Application Priority Data

Feb. 27, 2002 (DE) ..... 102 08 345

(51) Int. Cl.[7] ..... B26B 1/08
(52) U.S. Cl. ..... 30/2; 30/112
(58) Field of Search ..... 30/2, 162, 335

(56) References Cited

U.S. PATENT DOCUMENTS 3,999,290 A * 12/1976 Wood ..... 30/2
5,617,635 A * 4/1997 Berns ..... 30/162
5,813,121 A * 9/1998 Gringer ..... 30/162
6,148,520 A * 11/2000 Berns ..... 30/2
2002/0029482 A1 3/2002 Peyrot

FOREIGN PATENT DOCUMENTS

DE 4315495 11/1994
EP 1177865 2/2002

* cited by examiner

*Primary Examiner*—Douglas D. Watts
(74) *Attorney, Agent, or Firm*—Herbert Dubno; Andrew Wilford

(57) ABSTRACT

A knife has a blade-carrying blade slide and a separate actuator slide, both urged by springs into rear positions. A transversely displaceable coupling member on one of the slides is engageable with the other of the slides for coupling the blade slide with the actuator slide for movement of the blade slide from its retracted position into its intermediate position on displacement of the actuator slide from its rear end position into its front end position and for decoupling the slides from each other and shifting transversely out of a path of the other slide on movement of the blade slide from its intermediate position into its extended position. Cam formations on the slides displace the blade slide into the extended position on exertion of a transverse force against the blade edge in the intermediate position of the blade.

7 Claims, 3 Drawing Sheets

10
11
19
21
40
39
38
35
37
33
32
27
42
48
K
H
29
L
N
GV
GE
P
34
46
18
M
25
26
16
17
A
20
24
13
23
22
LN
28
31
30
47
15
14
x
z
α

10
11
40
39
38
21
18
19
46
M
25
26
20
16
17
24
13
37
35
33
32
27
K
P
42
48
29
GE
GV
L
R
a
34
e
LN
28
31
22
30
47
15
Q
49
I

BOX CUTTER WITH AUTORETRACTING BLADE

FIELD OF THE INVENTION

The present invention relates to utility knife. More particularly this invention concerns box cutter with an autoretracting blade.

BACKGROUND OF THE INVENTION

In commonly owned U.S. Pat. No. 6,148,520 a box cutter is described having a housing and a blade slide carrying a blade and displaceable longitudinally in the housing between a rear retracted end position with the blade wholly received in the housing and a front extended end position with the blade extending forward from the housing and through an intermediate position. A spring urges the blade slide continuously rearward into the retracted position. An actuator slide is displaceable in the housing independently of the blade slide between a front end position and a rear end position and through an intermediate position and is provided with an externally accessible actuating formation. Another spring urges the actuator slide continuously into the rear position. A seat member on one of the slides is displaceable along a path on movement of the one slide between its end positions and a coupling member on the other of the slides is engageable in the seat member on forward movement of the actuator slide from its rear position into the intermediate position of the actuator slide for pushing the blade slide forward from its rear retracted position to its intermediate position on displacement of the actuator slide from its intermediate position to its front position. The members are disengaged from each other and the coupling member is displaced out of the path of the seat member on displacement of the blade from its intermediate position into its extended position.

Thus with this system the actuator slide is pushed from its rear position into its forward position to move the blade slide from its rear position into its intermediate position. When the blade is then engaged in a workpiece and, as is usual, rearward traction is applied to the knife to cut the workpiece with the blade, the blade is pulled into its forward position. This causes the coupling member to disengage itself from the seat member and move out of its path. When subsequently the blade is freed from the workpiece, its spring will pull it back into the retracted position even if the actuator slide remains in the front actuated position. Thus the blade can be extended, but once engaged in a workpiece will always automatically retract as soon as it is disengaged from the workpiece.

This arrangement has one significant drawback: When the blade is oriented perpendicular to the workpiece surface being cut, there is no significant longitudinal component of frictional force effective on the blade to move it into the extended or outer position. Thus if the user cuts into a box and then, before the blade has been pulled out into the outer position, pivots up the blade to a perpendicular position, or if the user stabs the knife to start with into the workpiece with the cutting edge perpendicular to the workpiece surface, it is likely that the blade and its slide will never even move into the outer position. The blade and actuator slides will remain coupled together so that, even if the tool is separated from the workpiece, the blade will remain extended, creating a serious potential for injury.

OBJECTS OF THE INVENTION

It is therefore an object of the present invention to provide an improved autoretracting box cutter.

Another object is the provision of such an improved autoretracting box cutter which overcomes the above-given disadvantages, that is whose blade will move into the outer position even if the knife's cutting edge is oriented perpendicular to the surface of the workpiece being cut.

SUMMARY OF THE INVENTION

The instant invention is an improvement on an autoretracting knife of the above-described type having a housing and a blade slide carrying a blade and displaceable longitudinally in the housing between a rear retracted end position with the blade wholly received in the housing and a front extended end position with the blade extending forward from the housing and through an intermediate position. The blade has an edge directed transversely and exposed outside the housing in the extended position, and a blade spring urges the blade slide continuously rearward into the retracted position. Furthermore, an actuator slide is displaceable longitudinally in the housing independently of the blade slide between a front end position and a rear end position and is provided with an externally accessible actuating formation. An actuator spring urges the actuator slide continuously into the respective rear position. A transversely displaceable coupling member on one of the slides is engageable with the other of the slides for coupling the blade slide with the actuator slide for movement of the blade slide from its retracted position into its intermediate position on displacement of the actuator slide from its rear end position into its front end position and for decoupling the slides from each other and shifting transversely out of a path of the other slide on movement of the blade slide from its intermediate position into its extended position. In accordance with the invention cam formations on the slides displace the blade slide into the extended position on exertion of a transverse force against the blade edge in the intermediate position of the blade slide.

Thus with the instant invention the cam formations will effectively displace the blade into the extended position when any force is exerted transversely against the blade edge. Of course a standard angled cut will be effective as in the prior-art system to pull the blade out, but with the system of this invention of the knife is stabbed into a workpiece with its blade perpendicular to the workpiece surface, and then pulled parallel to this surface, the cam formations will draw out the blade and uncouple the slides for automatic blade retraction when the cut is completed.

According to the invention the formations include at least one surface extending at an acute angle to a longitudinal direction of movement of the blade slide between its retracted and intermediate positions. More particularly the surface is formed on the blade slide.

The cam formations can according to the invention include another surface formed on the housing and extending at an acute angle complementary to that of the blade-slide surface. In this case the blade slide can be formed with a generally longitudinally extending notch having a wall forming the surface. Alternately the formations include a pin projecting transversely from the housing into the notch.

In another arrangement according to the invention the cam formation is constituted by an L-shaped lever on the blade slide.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
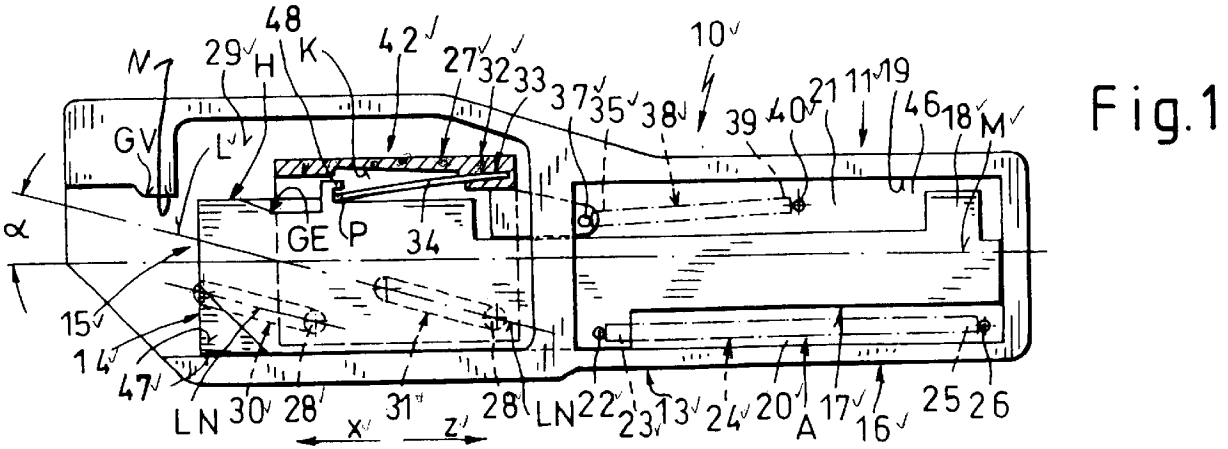
FIG. 1 is a sectional side view of the knife according to the invention in the rest position.
Figure 2:
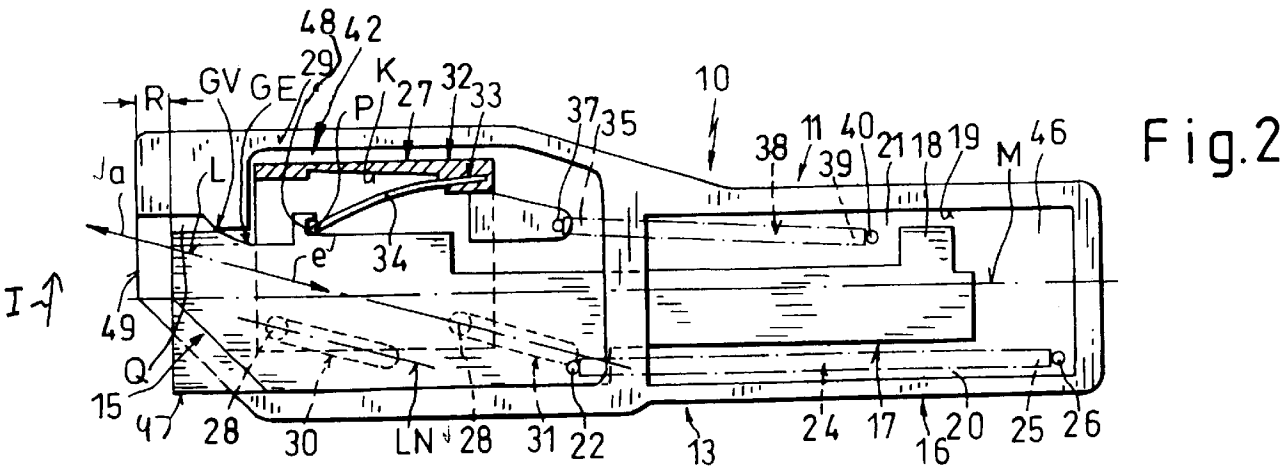
FIG. 2 is a view like FIG. 1 of the parts with the blade slide in its intermediate position and the actuator slide in its front end position.
Figure 3:
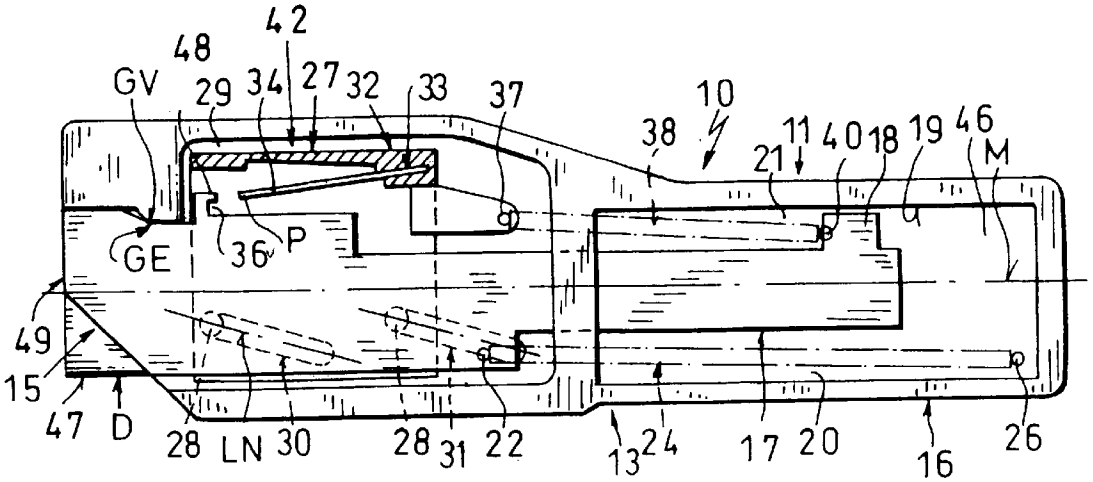
FIG. 3 is another view like FIG. 1 showing the blade slide nearly in its fully extended position.

As seen in FIGS. 1 and 2 a box-cutter knife 10 according to the invention has a housing 11 formed by a pair of molded plastic housing parts 13 (only one shown) that fit together to form a cavity 46. A blade 14 held in a molded plastic blade slide 15 is displaceable along an axis M in an outward or forward direction x into a fully extended position (FIG. 4) and in an opposite inward or rearward direction z into a retracted position (FIG. 1) and through an intermediate position (FIGS. 2 and 3). In the intermediate and extended positions an exposed corner 47 of the blade 14 can be engaged with a workpiece 45 (FIG. 4) to cut it.

The blade slide 15 has a rear end 17 housed in a handle part 16 of the housing 11 and formed with a lateral extension 18 riding on an inside guide surface 19 of the parts 13. This rear slide end 17 is cut away on its opposite sides at 20 and 21. The cutout 20 holds a tension spring 24 having a front end 23 hooked in a pin or eye 22 formed in the slide 15 at its middle and a rear end 25 hooked around an anchor pin 26 formed at the rear end of the handle part 16.

A molded plastic actuator slide 27 can move in the housing 11 underneath the slide 15 in a direction L forming a small acute angle $\alpha$ with the axis M, outward or forward in a direction a into a front position (FIGS. 2, 3, and 4) and inward or rearward in a direction e into a rear position (FIG. 1), like the slide 15 along the axis M in the directions x and z. The bottom face of the actuator slide 27 is formed with two parallel laterally projecting pins 28 that engage in respective angled grooves 30 and 31 formed in the inside wall 29 of the bottom housing part 13. The grooves 30 and 31 have axes LN that extend parallel to the direction M and in fact define this direction L in that the sliding engagement of the pins 28 in the grooves 30 and 31 constrains the actuator slide 27 to move only in the direction L.

The slide 27 has a lateral projection 32 holding a rear end 33 of a stiff spring-steel arm 34 forming a coupling member that can engage in a notch 36 formed in a lateral projection or seat member 48 of the slide 15. A tension spring 38 accommodated in the cutout 21 of the rear extension 17 has a front end 35 hooked at 37 to the slide 27 and a rear end 39 hooked around an anchor pin 40 formed on the housing part 13 adjacent its rear end. Thus this spring 38 continuously urges the slide 27 backward in the direction z.

An unillustrated cutout in the top cover part 13 exposes a pusher button 42 having a thumb seat and unitarily formed with the actuator slide 27. To this end the slide 27 is of C-section, engaged around three sides of the slide 15 and is unitarily formed of a durable plastic with this button 42.

In accordance with the invention the blade slide 15 is not constrained for movement purely longitudinally, that is parallel to the axis M, but can move limitedly at least at its front end transverse to the direction in the plane of the blade 14. To this end the front end of the housing 10 is formed with an inclined camming surface GV that extends at an angle of about 45° to the axis M, and immediately rearward thereof has a straight guide surface N parallel to the axis M. A front end of the blade slide 15 has a frontmost surface H extending parallel to the direction and, immediately behind it, an inclined camming surface GE complementary to the surface GV.

The knife 1 is operated as follows:

Under normal circumstances the parts are in the position of FIG. 1, with the two slides 15 and 17 in their rearmost positions and the blade 14 wholly retracted into the housing 11. The surfaces H and N are out of contact with each other. In this position the knife 10 can be safely handled or carried in a pocket.

For use the user applies a forward force on the button 42 to push the actuator slide 27 forward. This action catches the front end of the entrainment spring 34 in the notch or seat 36 of the seat 48 of the blade slide 15. Further forward movement of the slide 27 in direction a as shown in FIG. 2 makes the spring 34 push the slide 15 forward in the direction x with the surfaces N and H sliding on each other. Due to movement of the slide 27 in direction L, which forms the small acute angle $\alpha$ with the direction M along which the slide 15 is constrained to move by the engaging surfaces N and H, this action causes the spring 34 to bend, without however disconnecting the slides 15 and 27 from each other, until the pins 28 reach front stop ends of the slots 30 and 31 as shown in FIG. 2. In this position the tip 47 of the blade 14 is extended from the housing 11 in the intermediate position of the slide 15.

Figure 4:
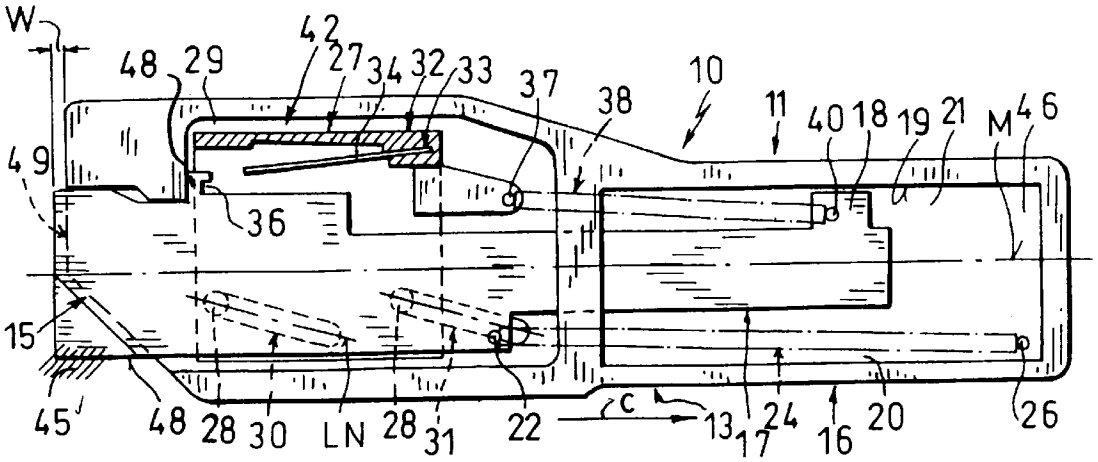
FIG. 4 is yet another view like FIG. 1 but with the blade in the fully extended position.

On engagement of the blade tip 47 in the workpiece 45 as shown in FIG. 4, the friction between the blade 14 and this workpiece 45 as the blade 14 is drawn backward in direction C to cut the workpiece 45 will pull the blade 14 and its holder 15 out a short distance W into the front end position shown in FIG. 4. Alternately, a transverse force in direction I will cause the two camming surfaces GE and GE, which by now are just engaged with each other, to cam the blade out in the direction x. Such movement will disconnect the coupling formation 48 from the spring 34, allowing its end to snap out of the seat 36 and move out of longitudinal alignment with the formation 48. Cutting can progress with the friction of the blade 14 in the workpiece 45 holding the blade 14 in the FIG. 4 extended position.

In this position if the actuator slide 27 is released it will snap back into its rear unactuated position. Meanwhile, however, the friction of the blade 14 in the workpiece 45 will maintain the blade 14 extended. Of course if the blade 14 is pulled out of the workpiece 45, it will snap back into the position of FIG. 1 due to the action of the spring 24.

On the other hand if in the position of FIG. 4 the user keeps his or her thumb on the button 42, holding the actuator slide 27 in its forward actuated position, the blade 14 is still free to snap back into the housing 11 if it is disengaged from the workpiece 45 as shown in FIG. 3. In other words the slide 27 must be actuated to extend the blade 14, but once the blade 14 is engaged in the workpiece 45, whether or not the slide 27 is actuated is irrelevant with respect to return of the blade 14 to the retracted position. The user can safely, for instance, pocket the knife 10 without taking his or her thumb off the button 42.

Figure 2A:
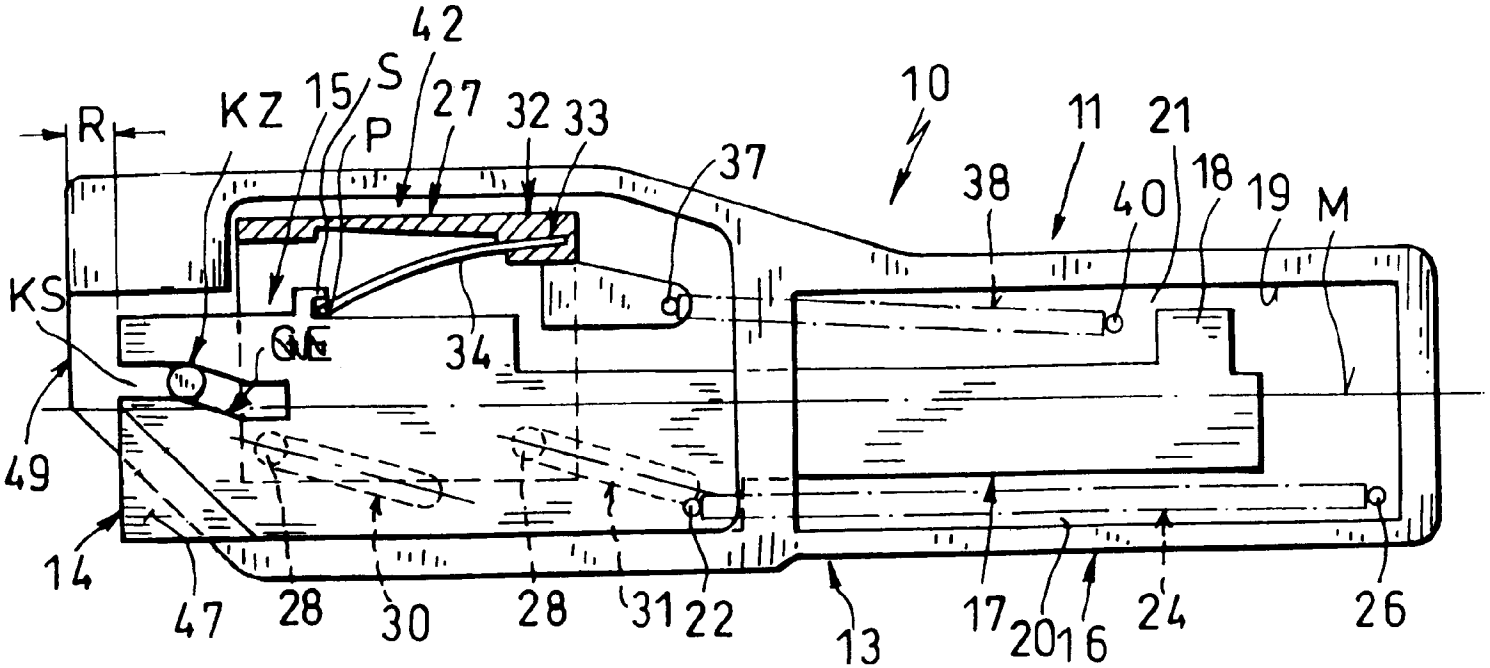
FIG. 2A is a view like FIG. 2 of an alternative arrangement according to the invention.

FIG. 2A shows an arrangement where the housing 10 is provided with a transversely extending cam pin KZ that engages through a flattened Z-shaped notch KS formed at the front end of the blade slide 15. As the blade slide 15 moves forward as described above, initially the front or outer portion of the notch KS causes the slide 15 to move only longitudinally in direction M. Once the cam pin KZ is engaged in a center angled portion of the notch KS, a lateral force in the direction I cams the slide 15 out as described above until finally the cam pin KZ slides longitudinally along an inner or rear portion of the notch KS.

I claim:

1. An autoretracting knife comprising:

a housing;

a blade slide carrying a blade and displaceable longitudinally in the housing between a rear retracted end position with the blade wholly received in the housing and a front extended end position with the blade extending forward from the housing and through an intermediate position, the blade having an edge directed transversely and exposed outside the housing in the extended position;

a blade spring urging the blade slide continuously rearward into the retracted position;

an actuator slide displaceable longitudinally in the housing independently of the blade slide between a front end position and a rear end position and provided with an externally accessible actuating formation;

an actuator spring urging the actuator slide continuously into the respective rear position;

coupling means including a transversely displaceable coupling member on one of the slides engageable with the other of the slides for coupling the blade slide with the actuator slide for movement of the blade slide from its retracted position into its intermediate position on displacement of the actuator slide from its rear end position into its front end position and for decoupling the slides from each other and shifting the coupling member transversely out of a path of the other slide on movement of the blade slide from its intermediate position into its extended position; and means including cam formations on the slides for displacing the blade slide into the extended position on exertion of a transverse force against the blade edge in the intermediate position of the blade slide.

2. The autoretracting knife defined in claim 1 wherein the formations include at least one surface extending at an acute angle to a longitudinal direction of movement of the blade slide between its retracted and intermediate positions.

3. The autoretracting knife defined in claim 2 wherein the surface is formed on the blade slide.

4. The autoretracting knife defined in claim 3 wherein the formations include another surface formed on the housing and extending at an acute angle complementary to that of the blade-side surface.

5. The autoretracting knife defined in claim 2 wherein the blade slide is formed with a generally longitudinally extending notch having a wall forming the surface.

6. The autoretracting knife defined in claim 5 wherein the formations include a pin projecting transversely from the housing into the notch.

7. The autoretracting knife defined in claim 1 wherein the coupling means further includes:

a seat member on one of the slides and displaceable along a path on movement of the one slide between its end positions, the coupling member being on the other of the slides and engageable in the seat member on forward movement of the actuator slide from its rear position into its intermediate position for pushing the blade slide forward from its rear retracted position to its intermediate position on displacement of the actuator slide from its intermediate position to its front position; and decoupling means connected to the coupling member for disengaging the members from each other and displacement of the coupling member transversely out of the path of the seat member on displacement of the blade from its intermediate position into its extended position.

* * * * *